United States Patent [19]

Petersen

[11] 4,177,894

[45] Dec. 11, 1979

[54] LENS CASE

[76] Inventor: Steven D. Petersen, 5316 Lewis Rd., Agoura, Calif. 91301

[21] Appl. No.: 923,705

[22] Filed: Jul. 11, 1978

[51] Int. Cl.[2] ..... B65D 85/38

[52] U.S. Cl. ..... 206/316; 206/594

[58] Field of Search ..... 206/316, 594

[56] References Cited

U.S. PATENT DOCUMENTS

| | | | |
|---|---|---|---|
| 2,780,348 | 2/1957 | Harter et al. | 206/316 |
| 3,828,991 | 8/1974 | Moore | 206/316 X |

*Primary Examiner*—George T. Hall

*Attorney, Agent, or Firm*—Lowell G. Turner

[57] ABSTRACT

A lens case for storing and transporting a photographic lens in a substantially environmentally sealed condition, the case including a tubular body portion bonded to an open end-encompassing base. Positioned interiorly of and disposed in spaced relation from the body is a tubular liner covered by a felt-like padding material. A foamed, resilient secondary shock-absorbing liner is usually provided interiorly of the liner and covering the bottom. The exterior of the body portion and its mated end are covered with leather or the like. A cover member is configured similar to the bottom portion and is also interiorly padded and exteriorly covered. Strap-type hinge means, including a belt loop, connects the body to the cover. Strap-type latch means is affixed to the top and adapted for latching to the body. Carrying strap attachment loops are also provided on the sides of the body.

11 Claims, 5 Drawing Figures

LENS CASE

BACKGROUND OF THE INVENTION

Special lenses are routinely required for use with photographic equipment. Despite the delicacy of such instruments, they must be readily transportable and extractable from their carrying case if they are to be useful. Hence, the lens case must incorporate packing materials capable of protecting the lens from shock and from environmental conditions such as moisture and heat, while still being of reasonable structural integrity and attractiveness.

There have been many attempts utilizing a variety of approaches, to design and fabricate such a case, but with only minor success. For example, some prior art units have been provided with tubular bodies encompassed by coverings of leather, plastic, or the like. Bottoms of cardboard or similar material have usually been provided within such covering to receive and support the weight of the lens. Nowhere in my experience, however, have photographers been provided with a lens case which is capable of simultaneously resisting high impact loads, adequately protecting the encased lens from the resulting shocks, and defining a structure which is substantially environmentally sealed. Moreover, a lens case incorporating such desirable features, while additionally including temperature insulating qualities and being attractive in appearance, easy to open and close, and readily adaptable for transport is even more unique.

It is therefore a primary object of this invention to provide a case for photographic lenses and the like which includes each of these desirable features and which, additionally, is readily adapted to economical manufacturing procedures.

BRIEF DESCRIPTION OF THE INVENTION

The foregoing objects of this invention are met by providing a generally tubularly constructed lens case wherein the body includes an outer wall comprising a tubular plastic member of rigid and structurally sound material, and which has a secondary, inwardly spaced, tubular member internally thereof. Primary cushioning materials are disposed internally of the second tubular member and against the internal surface of the base.

Integrally bonded to the lower extremity of the outer case is an injection molded bottom or base member, preferably of the same plastic material as the outer case. Externally of both the outer case and the lower extremity of the base member is disposed a material which is relatively soft for additional cushioning, but still aesthetically pleasing.

A cover or cap member is manufactured in essentially the same configuration and from the same material as the body and base members. It is also padded exteriorly and interiorly in substantially the same manner as the body.

A strap member, usually of the same material as the exterior cover material, is attached to both the body and the cap so as to provide a flexible hinge therebetween and to define a belt loop for carrying purposes. Similarly, a latch member is attached to an opposite side of the cover and is adapted to be fastened to the body.

DETAILED DESCRIPTION OF THE DRAWINGS

Figure 1:
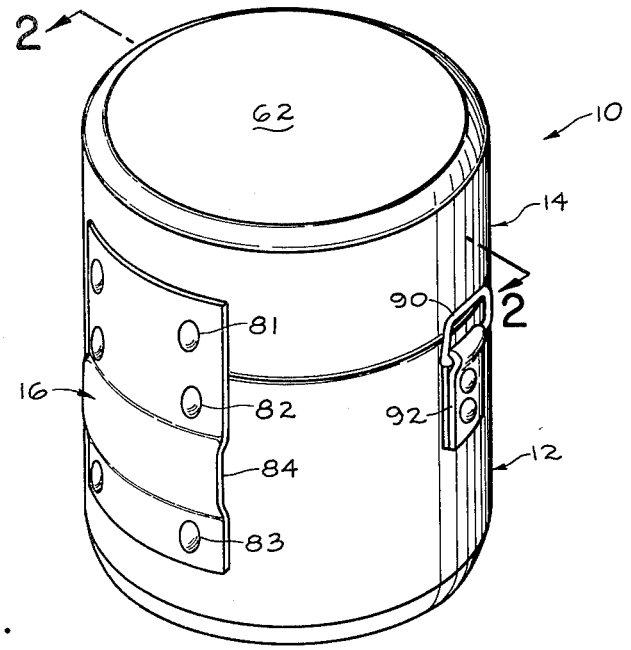
FIG. 1 is a perspective view of the lens case of this invention.

The lens case of this invention is generally indicated throughout the drawings by the numeral 10. A lens-receiving body portion 12 and a cover or lid 14 are interconnected by a strap-type hinge member 16.

The body 12 and the lid 14, which are of the same diameter and usually circular, each includes as a primary structural element a tubular body member 18, preferably fabricated from a relatively rigid plastic material such as polypropylene having a wall thickness approximating 3/32's of an inch in thickness.

The tubular body member 18 is conventionally bonded at its lower end to an end-encompassing end closure or base member 22, formed from the same material. The base 22 preferably has rounded corners 24, and a recess 26 in its lower surface. A disc of padding material 28, preferably manufactured from leather or a leather-like plastic material having an attractive physical appearance, is fixed within the recess 26 so as to be flush with the bottom of the base 22. This material provides a small amount of resiliency or padding for protection of the encased equipment. Extending upward from the inner surface of the base 22 in the preferred embodiment is a circular ridge 30 having an outer surface 32 normal to the plane of the base 22 and a sloped inner surface 34. The outer surface 32 has a diametric dimension which facilitates its telescopic nesting within the lower extremity of the tubular body member 18. Although these two members may be otherwise affixed to one another, in the usual instance they are adhesively bonded to one another in a conventional manner and so as to provide a fixed, integral structure in an environmentally sealed relationship.

Located internally of the body member 18 is a spacer means 36 comprising a tubular sleeve 38, usually constructed from cardboard or the like, its diameter being substantially equal to the inner diameter of the sloped ridge surface 34, one of its ends nesting interiorly thereof against an upper surface 40 of the base 22. When so oriented it is in a spaced relationship to the inner surface of the body member 18. The upper extremity of the sleeve 38 is so maintained by the interposition of a felt or similar material 42 which extends downward between the sleeve 38 and an upper end 44 of the body 18. This material 42 then extends upward over the upper extremity of the sleeve 38 and downward over its inner length so as to provide an attractive and shock-absorbing padding material interiorly of the lens case 10. In the usual instance this material 42 is adhesively bonded to the tubular sleeve 38.

A disc 46 of cushioning material, fabricated from a foamed elastomer, is disposed against the upper surface 40 of the base 22 interiorly of the felted sleeve 38. A tubular sleeve 48 of the same material is positioned internally of the spacer means 36 for its shock-absorbent characteristics. The upper end of the foamed plastic sleeve 48 usually terminates approximately coextensive with the upper end 44 of the body member 18, and an upper end 50 of the spacer means 36 extends upward beyond the end 44 of the body, usually about ½".

Externally of the circular ridge 30 upon the base 22 is a ledge 52 of sufficient width to accept the thickness of the tubular body member 18 and an external decorative and shock-absorbing cover 54, normally made from the same material as disc 28. This material terminates at its lower extremity against the ledge 52. Its opposite end is wrapped over the upper end 44 of the body 18, then extends downward interiorly thereof, where it cooperates with the material 42 as a spacer between the tubular body member 18 and the sleeve 38. This results in the provision of a dead air space 56, which acts as an insulator for better controlling the environment of the interior of this lens case. It additionally provides a secondary shock-absorbing capability since a reasonable amount of flexibility is built into the spacer means 36, the space 56 providing a limited movement capability for that structure.

The lid 14 is constructed very similar to the body 12. An end-encompassing top 58 is identical to the base 40, except that its upper surface 60 is sometimes curved to provide an attractive appearance, and to shed water whereas the lower surface of the base 22 is usually flat to facilitate a free standing capability. A disc 62, similar to the disc 28, is disposed within a recess 64 in the surface 60 for shock absorbency and aesthetic purposes. The outer corner 66 of the top 58 is rounded and a recess 68 is defined interiorly of the top 60 by virtue of the presence of a downwardly extending circular ridge 70, constructed in the same manner as the ridge 30 on base 22, to accept a disc of padding material 72 similar to the disc 46 within the body 18.

Wrapped around and adhered firmly to the body member 18 is a cover 74, of the same material as the layer 54. One of the cover ends 76 is positioned against a ledge 78 outwardly of the circular ridge 70, the material 74 being then wrapped around the lower end 80 of the tubular member 20 and upward to encompass the inner surface of the tubular member 20, terminating against the lower extremity of the circular ridge 70.

Figure 2:
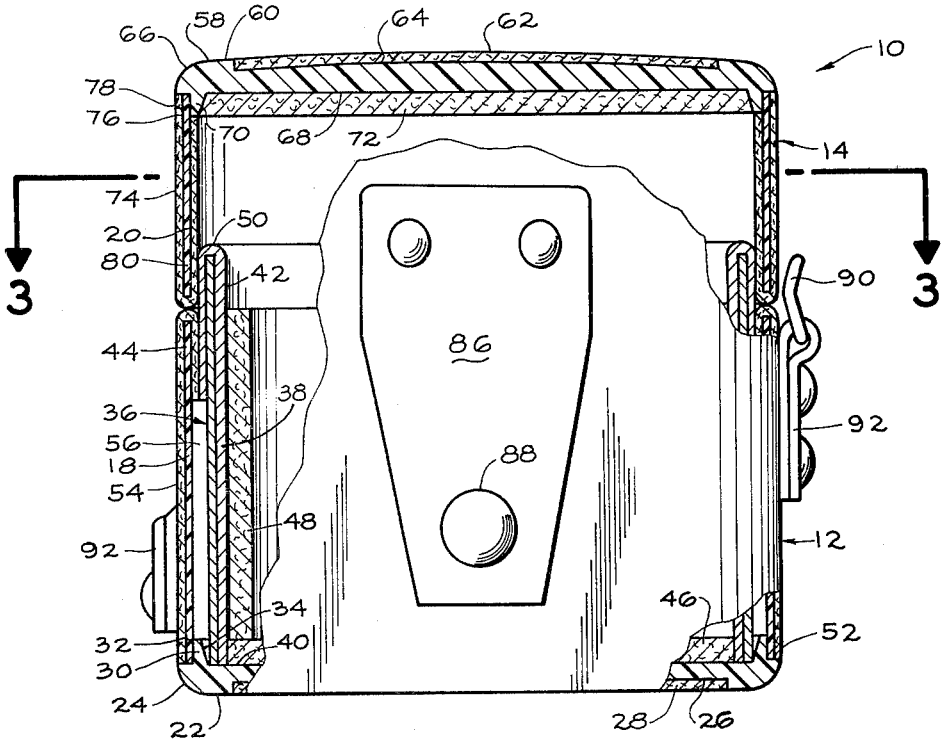
FIG. 2 is an elevational view, partially in section, taken generally along line 2—2 of FIG. 1.
Figure 3:
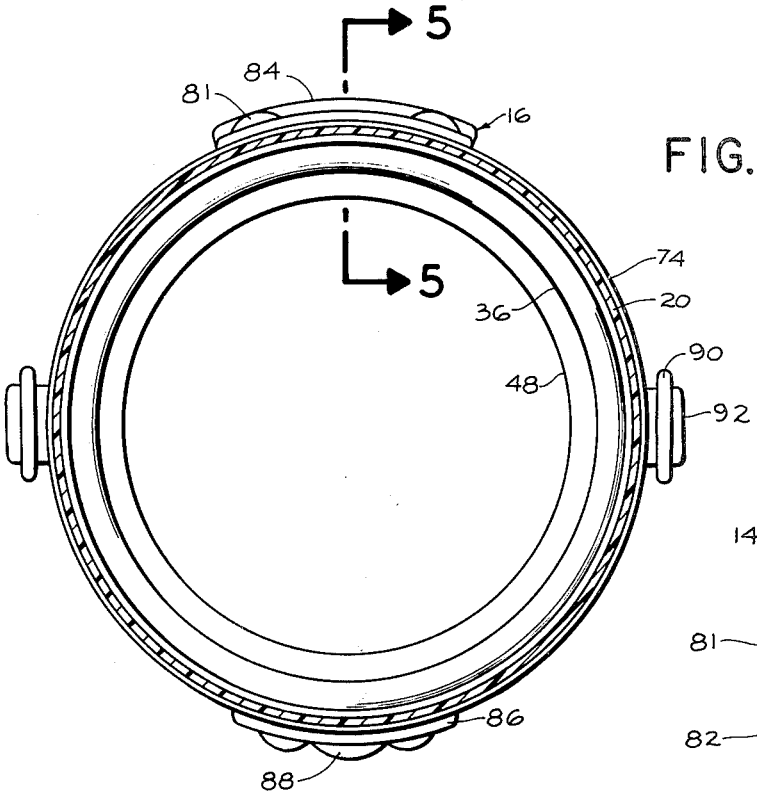
FIG. 3 is a sectional view taken generally along line 3—3 of FIG. 1.
Figure 5:
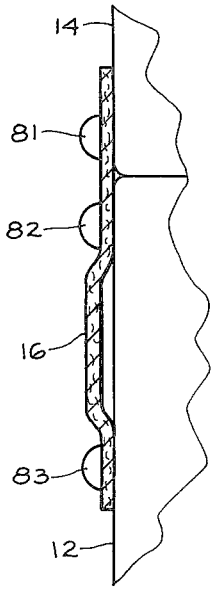
FIG. 5 is a section taken along line 5—5 of FIG. 4 to better illustrate the hinge and belt loop.
Figure 4:
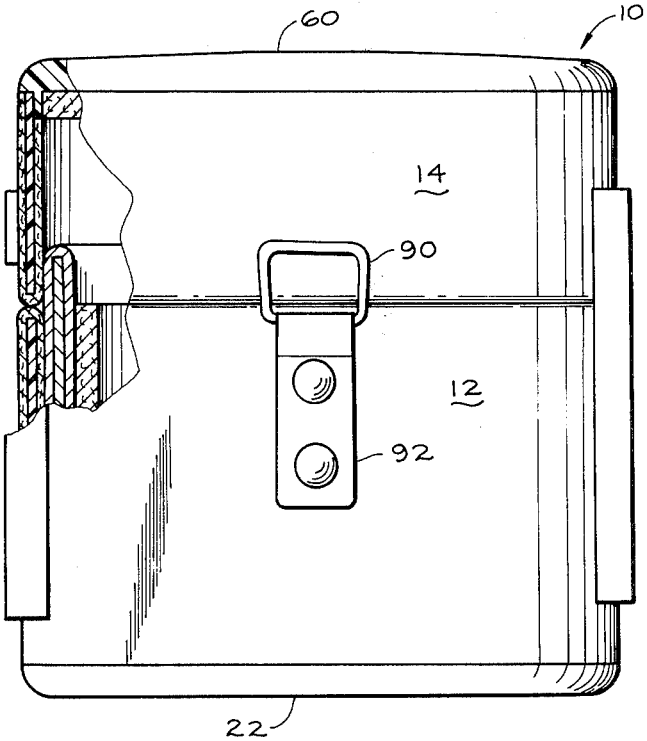
FIG. 4 is a full elevational view taken along line 4—4 of FIG. 3 and partially cut away.

It will be noted, particularly in FIGS. 2 and 4, that when the lid 14 is closed in the manner illustrated, it extends downward over the extremity 50 of the sleeve 30 in a slip-fit with respect thereto, thus preventing the entrance of dust or other contaminants into the lens case 10.

The entire external and internal treatment of the lid and body components of this lens case also provides a highly pleasing aesthetic appearance to the assembly.

Attached to the external surfaces of the body 12 and the lid 14 is a strap-type hinge member 14, usually riveted with large headed anti-corrosive rivets, such as illustrated at 81, 82, and 83 in FIG. 1. The rivets extend through the tubular members 20 and 18, respectively and are headed interiorly thereof so as to firmly fix the hinge to the structural portions of the lens case. Thus, the lid 14 may be moved upward about the hinge 16 to facilitate ready insertion and removal of the lens equipment from the case. The hinge 16 also extends downward beyond the rivets 82 and is terminated at its lower extremity by rivets 83 at a distance sufficient to define a loop 84 through which a belt may be inserted for carrying the lens case 10. The rivets 83 are also fastened through the body 18.

A latch member 86, also fabricated from the same material as hinge 16, is similarly riveted to the lid 14 opposite the hinge 16. It extends downward and includes a snap member 88 near its lower extremity, the receiving portion of the latch (not shown) being fastened through the body 18.

At positions substantially normal to the hinge 16 and the latch 86 are a pair of strap attachment loops 90 mounted by strap-type receivers 92 for swiveling. Again the receivers 92 are riveted to the body 18. Thus, a standard strap may be looped through the strap attachment loops 90 to facilitate an easy carrying capability of the case 10. In the usual instance the receivers 92 are made from the same material as the balance of the exterior of this case.

Through the various features illustrated and described each of the objects of this invention is met. It will be understood that the various features described are by way of illustration only and are not to be considered as limiting the nature or scope of the respective features thereof.

I claim:

1. A lens case comprising:

a pair of tubular body members, each having a first open end, and an opposite end closed by an end-encompassing member attached thereto, said body members being coaxially disposed when said case is closed;

padding material disposed within said body members and against said end members;

hinge means connecting said body members; and latch means affixed to one said body member and releasably attached to the other.

2. The lens case of claim 1 wherein:

spacer means is disposed internally of one of said body members in spaced relation therefrom and against said closed end thereof.

3. The lens case of claim 2 wherein:

said spacer means extends beyond said open end of said one body member and into the other said tubular body when said open ends are mated.

4. The lens case of claim 1 wherein:

each said body member and its end-encompassing member are retained together as integrated structures.

5. The lens case of claim 1 wherein:

said body members are of the same cross sectional configuration, and said end-encompassing members are of substantially the same configuration.

6. The lens case of claim 2 wherein:

said spacer means is a tubular member having a soft cushioning material disposed over an internal surface thereof, over the external surface thereof which extends beyond said open end of said one body member, and into that said open end between that open and said tubular member.

7. The lens case of claim 6 wherein:

a tubular-shaped member of elastomeric material is disposed inwardly against said spacer means and pads of similar material are positioned inwardly of and against said end members.

8. The lens case of claim 6 wherein:

at least the major portion of all external surfaces of said lens case are encompassed by a decorative material having padding qualities, and said hinge means includes belt-receiving means associated therewith for carrying purposes, and carrying strap attachment means is attached to said one end externally thereof.

9. A lens case comprising:

a hollow, cylindrical, substantially rigid body portion having a first open end and a second end closed by an end member attached to said body portion;

shock and vibration-resistant material upon said body and said closed end;

a hollow, cylindrical, substantially rigid lid portion having a first open end for mating with said open end of said body and a second end closed by an end member attached to said last-mentioned cylindrical portion;

spacer means disposed internally of said body portion against said closed end thereof, extending beyond the open end thereof and into said lid portion when said open ends are mated; and hinge means flexibly connecting said body portion and said lid portion.

10. The lens case of claim 9 wherein:

said body portion and said lid portion are constructed from a plastic material, the cylindrical portions thereof bonded to the end members and the end members being of injection molded plastic construction.

11. The lens case of claim 10 wherein:

said end members are substantially flat, but having a circular ridge extending upward from one side thereof, said ridges being sized to nest within said cylindrical members in a supporting and positioning relationship.

* * * * *